US005975048A

United States Patent [19]

Sivashankar et al.

[11] Patent Number: 5,975,048

[45] **Date of Patent: *Nov. 2, 1999**

[54] IDLE SPEED CONTROL SYSTEM FOR DIRECT INJECTION SPARK IGNITION ENGINES

[75] Inventors: Narayanan Sivashankar, Canton; Jing Sun, Novi, both of Mich.

[73] Assignee: Ford Global Technologies, Inc., Dearborn, Mich.

[ * ] Notice: This patent is subject to a terminal disclaimer.

[21] Appl. No.: 08/951,374

[22] Filed: Oct. 16, 1997

[51] Int. Cl.[6] ..... F02M 3/00

[52] U.S. Cl. ..... 123/339.12; 123/339.14; 123/295

[58] Field of Search ..... 123/339.1, 339.11, 123/339.12, 339.19, 339.14, 295, 305

[56] References Cited

U.S. PATENT DOCUMENTS

| | | | |
|---|---|---|---|
| 4,721,082 | 1/1988 | Hibino et al. | 123/339.12 |
| 5,031,594 | 7/1991 | Morikawa | 123/339.19 |
| 5,203,300 | 4/1993 | Orzel | 123/339.12 |
| 5,628,290 | 5/1997 | Iida et al. | 123/305 |
| 5,630,394 | 5/1997 | Grizzle et al. | 123/339.19 |
| 5,894,828 | 4/1999 | Sivashankar et al. | 123/339.12 |

*Primary Examiner*—Willis R. Wolfe
*Assistant Examiner*—Hieu T. Vo
*Attorney, Agent, or Firm*—Allan J. Lippa

[57] ABSTRACT

An idle speed control system for a direct injection spark ignition engine controlled to operate in either homogeneous air/fuel modes or stratified air/fuel modes. When operating in a stratified air/fuel mode, engine idle speed is controlled by controlling the engine air/fuel during unthrottled operation. When operating stratified and also throttled, engine idle speed is controlled by both controlling air/fuel and controlling the throttle. When operating in the homogeneous modes, engine idle speed is controlled by controlling both the throttle and ignition timing.

11 Claims, 3 Drawing Sheets

IDLE SPEED CONTROL SYSTEM FOR DIRECT INJECTION SPARK IGNITION ENGINES

BACKGROUND OF THE INVENTION

The field of the invention relates to idle speed control systems for internal combustion engines. In particular, the field relates to idle speed control systems for direct injection spark ignition engines.

In conventional port injected engines, which induct a mixture of air and atomized fuel into the combustion chambers, idle speed control systems are known which adjust idle speed by controlling the air throttle. It is also known to control idle speed by advancing or retarding ignition timing. An example of such a system is disclosed in U.S. Pat. No. 5,203,300.

The inventor's herein have recognized numerous problems when applying known idle speed control systems to direct injection spark ignition engines in which the combustion chambers contain stratified layers of different air/fuel mixtures. The strata closest to the spark plug contains a stoichiometric mixture or a mixture slightly rich of stoichiometry, and subsequent strata contain progressively leaner mixtures. Use of conventional idle speed control systems for this type of engine is recognized by the inventors herein to be inadequate because stratified operation is unthrottled so the throttle is not a viable control variable. And ignition timing is not a viable control variable because the timing must be slaved to the time a rich air/fuel strata is formed near the spark plug. These problems are further exasperated in direct injection spark ignition engines which have two modes of operation—the stratified mode discussed above and a homogeneous mode in which a homogeneous air/fuel mixture is formed at the time of spark ignition.

SUMMARY OF THE INVENTION

An object of the invention herein is to control idle speed of direct injection spark ignition internal combustion engines which have both homogeneous and stratified air/fuel modes of operation.

The above object is achieved, problems of prior approaches overcome, and the inherent advantages obtained, by providing an idle speed control method and system for a spark ignited engine having an air intake with a throttle positioned therein, a homogeneous mode of operation with a homogeneous mixture of air and fuel within the combustion chambers, and a stratified mode of operation with a stratified mixture of air and fuel within the combustion chambers. In one particular aspect of the invention, the method comprises controlling engine idle speed when in the stratified mode by controlling fuel delivered into the combustion chambers when throttling of air through the air intake is less than a predetermined value and by controlling both fuel delivered into the combustion chambers and controlling the throttle when throttling of air through the air intake is greater than a preselected value; and controlling engine idle speed when in the homogeneous mode by controlling the throttle. Preferably, the method includes controlling engine speed when in the homogeneous mode by controlling ignition timing.

An advantage of the above aspect of the invention is that idle speed control is accurately maintained regardless of whether a direct injection spark ignition engine is operating in a homogeneous mode or a stratified mode.

DESCRIPTION OF THE DRAWINGS

The object and advantages of the invention claimed herein will be more readily understood by reading an example of an embodiment in which the invention is used to advantage with reference to the following drawings wherein:

DESCRIPTION OF AN EXAMPLE OF OPERATION

Figure 1:
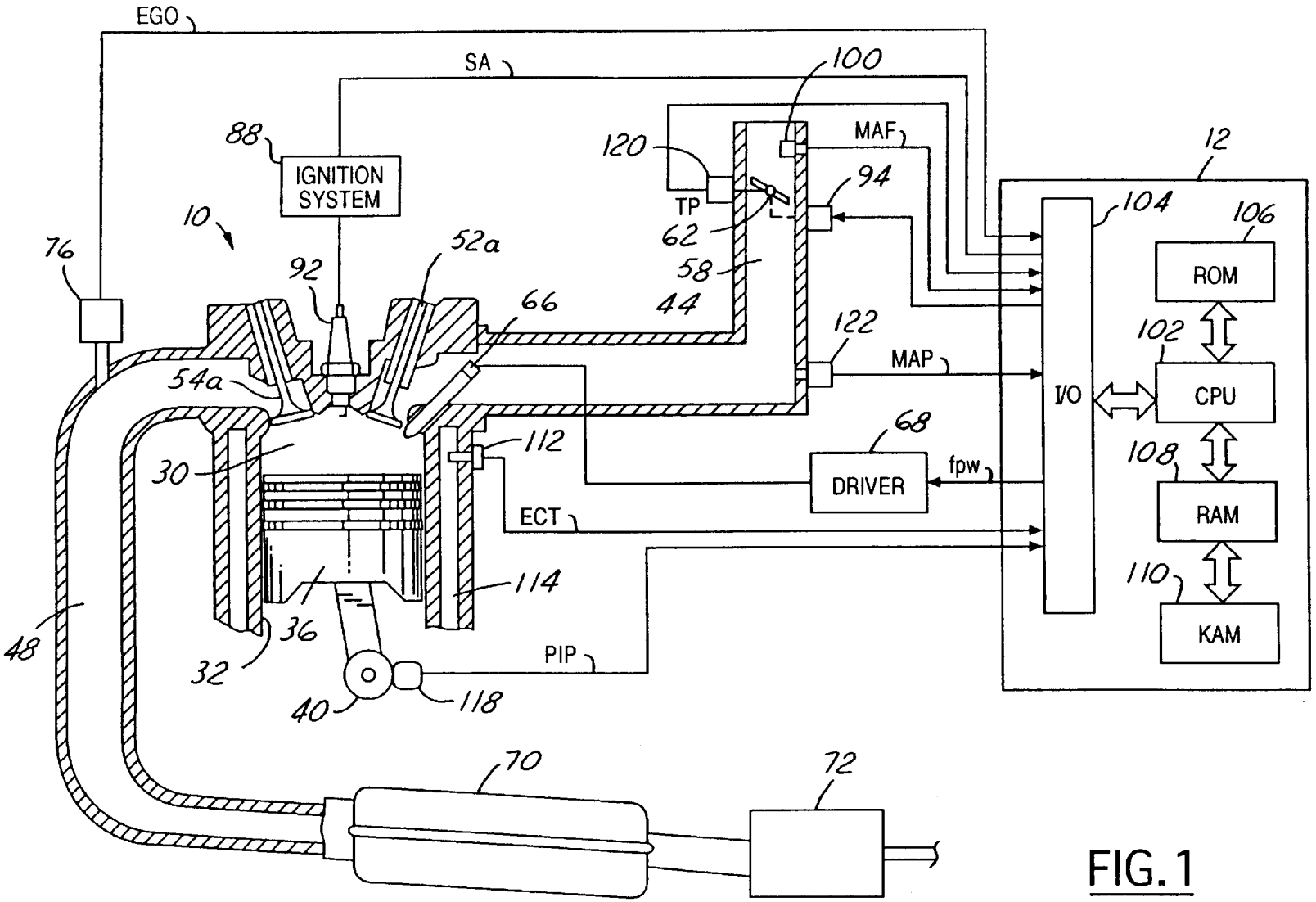
FIG. 1 is a block diagram of an embodiment in which the invention is used to advantage.

Direct injection spark ignited internal combustion engine 10, comprising a plurality of combustion chambers, is controlled by electronic engine controller 12. Combustion chamber 30 of engine 10 is shown in FIG. 1 including combustion chamber walls 32 with piston 36 positioned therein and connected to crankshaft 40. In this particular example piston 30 includes a recess or bowl (not shown) to help in forming stratified charges of air and fuel. Combustion chamber 30 is shown communicating with intake manifold 44 and exhaust manifold 48 via respective intake valves 52*a* and 52*b* (not shown), and exhaust valves 54*a* and 54*b* (not shown). Fuel injector 66 is shown directly coupled to combustion chamber 30 for delivering liquid fuel directly therein in proportion to the pulse width of signal fpw received from controller 12 via conventional electronic driver 68. Fuel is delivered to fuel injector 66 by a conventional high pressure fuel system (not shown) including a fuel tank, fuel pumps, and a fuel rail.

Intake manifold 44 is shown communicating with throttle body 58 via throttle plate 62. In this particular example, throttle plate 62 is coupled to electric motor 94 so that the position of throttle plate 62 is controlled by controller 12 via electric motor 94. This configuration is commonly referred to as electronic throttle control (ETC) which is also utilized during idle speed control. In an alternative embodiment (not shown), which is well known to those skilled in the art, a bypass air passageway is arranged in parallel with throttle plate 62 to control inducted airflow during idle speed control via a throttle control valve positioned within the air passageway.

Exhaust gas oxygen sensor 76 is shown coupled to exhaust manifold 48 upstream of catalytic converter 70. In this particular example, sensor 76 provides signal EGO to controller 12 which converts signal EGO into two-state signal EGOS. A high voltage state of signal EGOS indicates exhaust gases are rich of stoichiometry and a low voltage state of signal EGOS indicates exhaust gases are lean of stoichiometry. Signal EGOS is used to advantage during feedback air/fuel control in a conventional manner to maintain average air/fuel at stoichiometry during the stoichiometric homogeneous mode of operation.

Conventional distributorless ignition system 88 provides ignition spark to combustion chamber 30 via spark plug 92 in response to spark advance signal SA from controller 12.

Controller 12 causes combustion chamber 30 to operate in either a homogeneous air/fuel mode or a stratified air/fuel mode by controlling injection timing. In the stratified mode, controller 12 activates fuel injector 66 during the engine compression stroke so that fuel is sprayed directly into the bowl of piston 36. Stratified air/fuel layers are thereby formed. The strata closest to the spark plug contains a stoichiometric mixture or a mixture slightly rich of stoichiometry, and subsequent strata contain progressively leaner mixtures. During the homogeneous mode, controller 12 activates fuel injector 66 during the intake stroke so that a substantially homogeneous air/fuel mixture is formed when ignition power is supplied to spark plug 92 by ignition system 88. Controller 12 controls the amount of fuel delivered by fuel injector 66 so that the homogeneous air/fuel mixture in chamber 30 can be selected to be at stoichiometry, a value rich of stoichiometry, or a value lean of stoichiometry. The stratified air/fuel mixture will always be at a value lean of stoichiometry, the exact air/fuel being a function of the amount of fuel delivered to combustion chamber 30.

Nitrogen oxide (NOx) absorbent or trap 72 is shown positioned downstream of catalytic converter 70. NOx trap 72 absorbs NOx when engine 10 is operating lean of stoichiometry. The absorbed NOx is subsequently reacted with HC and catalyzed during a NOx purge cycle when controller 12 causes engine 10 to operate in either a rich homogeneous mode or a stoichiometric homogeneous mode.

Controller 12 is shown in FIG. 1 as a conventional microcomputer including: microprocessor unit 102, input/output ports 104, an electronic storage medium for executable programs and calibration values shown as read only memory chip 106 in this particular example, random access memory 108, keep alive memory 110, and a conventional data bus. Controller 12 is shown receiving various signals from sensors coupled to engine 10, in addition to those signals previously discussed, including: measurement of inducted mass air flow (MAF) from mass air flow sensor 100 coupled to throttle body 58; engine coolant temperature (ECT) from temperature sensor 112 coupled to cooling sleeve 114; a profile ignition pickup signal (PIP) from Hall effect sensor 118 coupled to crankshaft 40; and throttle position TP from throttle position sensor 120; and absolute Manifold Pressure Signal MAP from sensor 122. Engine speed signal RPM is generated by controller 12 from signal PIP in a conventional manner and manifold pressure signal MAP provides an indication of engine load.

Figure 2:
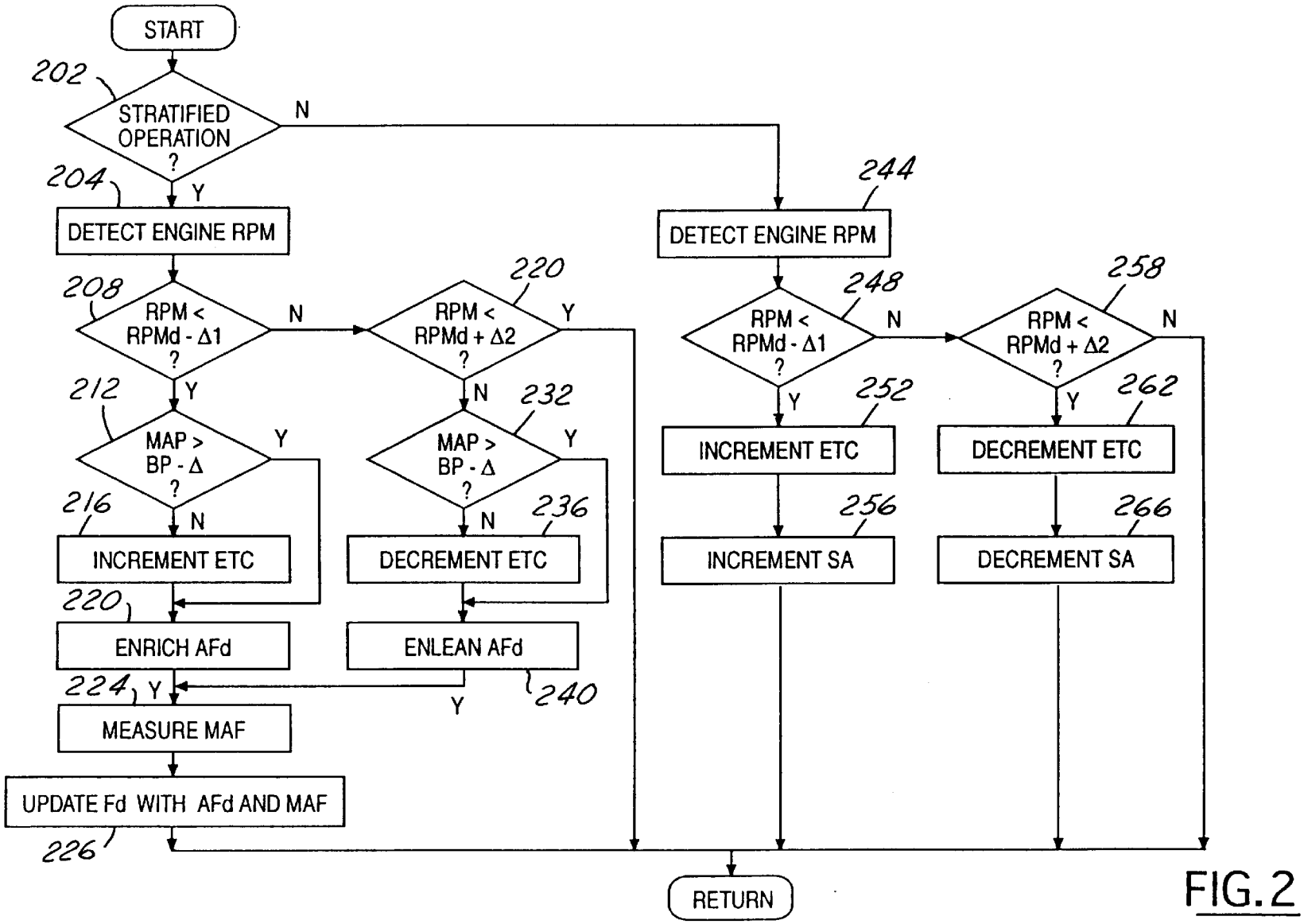
FIG. 2 is a high level flowchart which describes idle speed control for the embodiment shown in FIG. 1.

Referring now to FIG. 2, idle speed control operation is now described for the stratified and homogeneous modes of operation. When engine 10 is operated in the stratified mode (block 202), engine RPM is detected (block 204) and the following comparison is made. When engine RPM is less than desired engine speed RPMd $-\Delta 1$, which provides a deadband around desired speed RPMd (block 208), conditions are checked to see if engine 10 is throttled. In this particular example an indication of throttled conditions is provided, when manifold pressure signal MAP is less than barometric pressure BP minus $\Delta$ (block 212). In response, throttle plate 62 is incremented (block 216) by operation of the electronic throttle control (ETC). On the other hand, when engine manifold pressure signal MAP is greater than barometric pressure BP minus $\Delta$ (block 212), the position of throttle plate 62 is not changed and block 216 bypassed as shown in FIG. 2. Regardless of whether engine 10 is throttled or unthrottled, desired air/fuel signal AFd is enriched (block 220) whenever engine speed RPM is less than desired speed RPMd minus $\Delta 1$ (block 208).

When engine speed RPM is greater than desired engine speed RPMd $-\Delta 1$ (block 208), but less than desired engine speed RPMd $+\Delta 2$ (block 228), engine speed RPM is then known to be operating within a dead band around desired engine speed RPMd and no action is taken to change engine idle speed RPM. On the other hand, when engine speed is greater than desired speed RPMd $+\Delta 2$ (block 228), subsequent steps are taken to control engine idle speed as follows. Desired air/fuel AFd is enleaned (block 236) unless a lean limit is reached (block 232). If the lean limit is reached (block 232), the position of throttle plate 62 is decremented (block 240).

When in stratified operation (block 202), the routine described above continues by measuring inducted airflow MAF (block 224) and updating the fuel delivered to the combustion chambers (Fd) utilizing a measurement of inducted airflow (MAF) and desired air/fuel AFd.

A description of idle speed control during the homogeneous modes of operation is now described with particular reference to blocks 244–266. Engine speed RPM is detected (block 244) after homogeneous operation is indicated (block 202). When engine speed RPM is less than desired speed RPMd $-\Delta 1$ (block 248), throttle plate 62 is incremented (block 252) to increase idle speed. In addition, ignition timing SA is advanced (block 256) to more rapidly correct engine idle speed.

When engine speed RPM is greater than desired speed RPMd $+\Delta 2$ (blocks 248 and 258), throttle plate 62 is decremented or moved towards the closed position by action of electronic throttle control (ETC) as shown in block 262 to decrease engine speed. To further decrease engine speed, and do so rapidly, ignition timing is retarded in block 266.

When engine speed RPM is within a dead band around desired speed RPMd (blocks 248 and 258), no steps are taken to alter engine speed.

Figure 3:
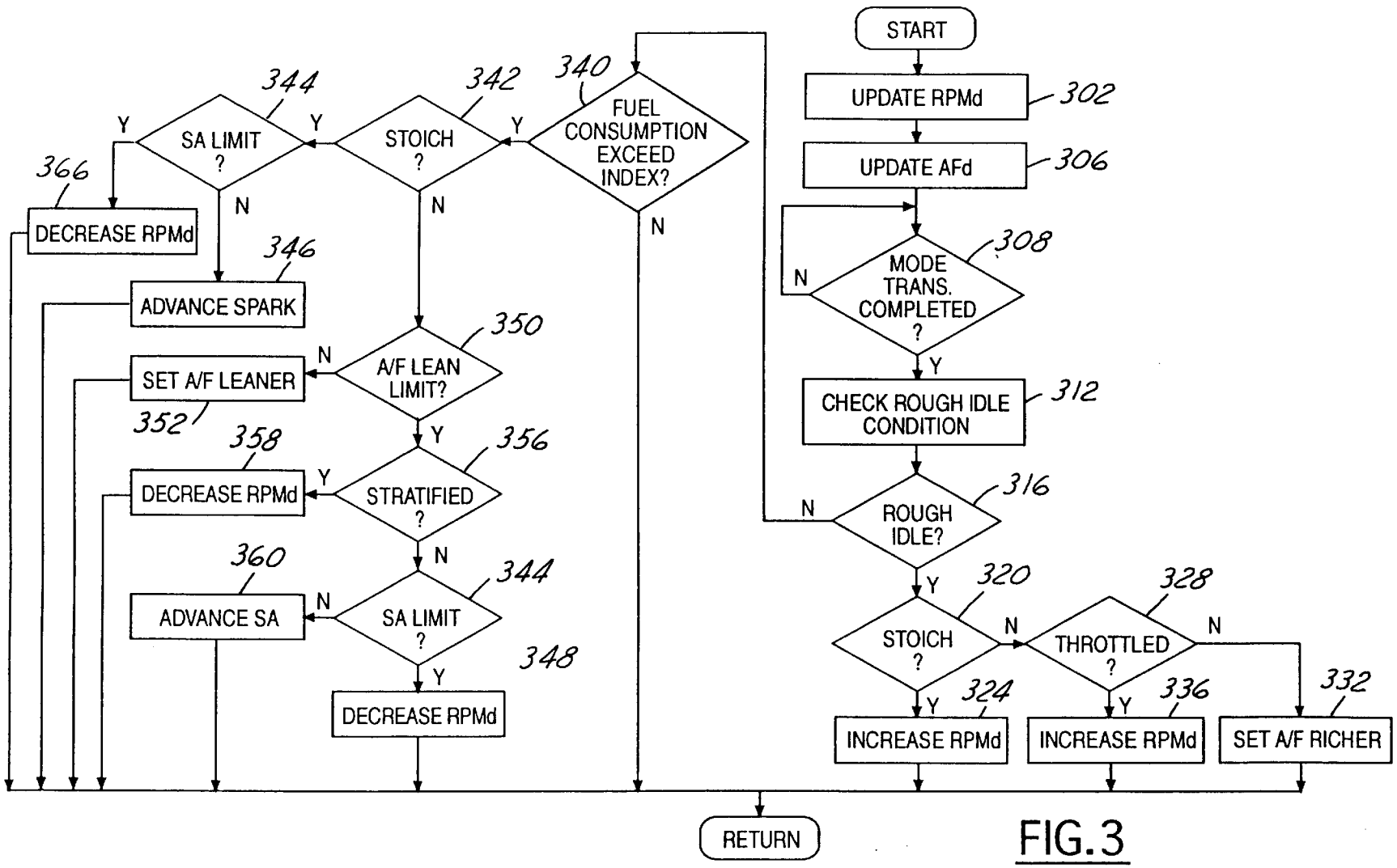
FIG. 3 is a high level flowchart showing how a desired idle speed is generated.

Referring now to FIG. 3, a high level flowchart is shown for generating a desired idle speed to maximize fuel economy without causing rough idle conditions. After the idle speed mode is started, desired idle engine speed RPMd (block 302) and desired air/fuel AFd (block 306) are updated. After a transition in modes from the previous operating mode is completed (block 308), a check for rough idle conditions is made (block 312). Rough idle is detected by detecting a change in crankshaft velocity. Those skilled in the art will recognize that there are many other methods for checking rough idle conditions. For example, variations in alternator current are commonly used as are abrupt changes in air/fuel of the combustion gas air/fuel.

When rough idle conditions are present (block 316), and engine 10 is operating at stoichiometry (block 320), desired idle speed RPMd is increased to smooth out the engine idle (block 324).

The following operations occur when engine idle is rough (block 316) and engine operation is at non stoichiometric air/fuel (block 320). If engine operation is also throttled (block 228), desired idle speed RPMd is increased (block 336). If, however, engine operation is unthrottled (block 228) and stratified, engine air/fuel is enriched until a rich limit is reached which will cause operation to switch to homogeneous (block 332).

In the absence of rough idle conditions (block 316), the following steps are implemented to maximize fuel economy during the idle speed mode. When rough idle is not present (block 316), and fuel consumption is greater than desired (block 340), and engine 10 is operating at stoichiometric air/fuel (block 342), ignition timing is advanced (block 346) until an ignition advance limit is achieved (block 344). If the ignition advance limit is reached (block 344), desired idle speed RPMd is decreased (block 348).

If rough idle engine conditions are absent (block 316), and fuel consumption is greater than desired (block 340), and engine 10 is not at stoichiometry (block 342), engine air/fuel is set leaner (block 352) unless the lean air/fuel limit has been reached (block 350). If the lean air/fuel limit has been reached (block 350), and engine 10 is operating in a stratified mode (block 356), desired idle speed RPMd is decreased (block 358). On the other hand, if engine 10 is not operating in the stratified mode (block 356), ignition timing is advanced (block 360) until an ignition advance limit is reached (block 362). If the ignition timing advanced has been reached (block 362), desired idle speed RPMd is decreased (block 366).

This concludes a description of an example of operation which uses the invention claimed herein to advantage. Many alterations and modifications will come to mind without departing from the scope of the invention. Accordingly, it is intended that the invention be defined only by the following claims.

We claim:

1. A computer storage medium having a computer program encoded therein for causing a computer to control idle speed of a spark ignited engine having an air intake manifold with a throttle valve positioned therein and having a homogeneous mode of operation wherein air and fuel are substantially a homogeneous mixture within the combustion chambers and a stratified mode of operation wherein air and fuel are substantially stratified within the combustion chambers, said computer storage medium comprising:

fuel control code means for causing a computer to enrich combustion chamber air/fuel when operating in the stratified mode and when engine idle speed is less than a first preselected idle speed;

throttle valve control code means for causing a computer to increase throttle valve opening when operating in the stratified mode and when the throttle valve is less than fully opened and when said engine idle speed is less than said first preselected idle speed;

said fuel control code causing a computer to enlean combustion chamber air/fuel when operating in the stratified mode and when said engine idle speed is greater than a second preselected idle speed; and said throttle valve control code means causing a computer to decrease throttle valve opening when operating in the stratified mode and when air/fuel is leaner than a preselected value and when said engine idle speed is greater than said first preselected idle speed.

2. An idle speed control method for a spark ignited engine having an air intake manifold with a throttle valve position therein and having a homogeneous mode of operation with the homogeneous mixture of air and fuel within the combustion chambers and stratified mode of operation with the stratified mixture of air and fuel within the combustion chambers, comprising:

adjusting fuel delivered into the combustion chambers to control engine idle speed to a desired engine speed when in the stratified mode of operation and when throttling of air through the air intake manifold is less than a predetermined value;

adjusting both fuel delivered into the combustion chambers and the throttle valve to control engine idle speed to said desired engine speed when in the stratified mode of operation and when throttling of air through the air intake manifold is greater than a preselected value; and adjusting the throttle valve to control engine idle speed to said desired engine speed when in the homogeneous mode of operation.

3. The method recited in claim 2, wherein said step of adjusting the throttle valve when in the homogeneous mode further comprises adjusting ignition timing.

4. The method recited in claim 2, when the homogeneous mode is generated by injecting fuel during an intake stroke of the engine in a stratified mode is generated by injecting fuel during the compression stroke of the engine.

5. An idle speed control method for a spark ignited engine having an air intake manifold with a throttle valve positioned therein and having a homogeneous mode of operation wherein air and fuel are substantially a homogeneous mixture within the combustion chambers and a stratified mode of operation wherein air and fuel are substantially stratified within the combustion chambers, comprising:

enriching combustion chamber air/fuel mixture when operating in the stratified mode and when engine idle speed is less than a first preselected idle speed;

increasing throttle valve opening when operating in the stratified mode and when the throttle valve is less than fully opened and when said engine idle speed is less than said first preselected idle speed;

enleanning combustion chamber air/fuel mixture when operating in the stratified mode and when said engine idle speed is greater than a second preselected idle speed; and decreasing throttle valve opening when operating in the stratified mode and when combustion chamber air/fuel mixture is leaner than a preselected value and when said engine idle speed is greater than said first preselected idle speed.

6. The method recited in claim 5 further comprising controlling engine idle speed when in the homogeneous mode by controlling the throttle valve.

7. The method recited in claim 6 wherein said step of controlling engine speed when in the homogeneous mode further comprises controlling ignition timing.

8. The method recited in claim 7 further comprising increasing said throttle valve opening and advancing said ignition timing when said idle speed less than said first selected idle speed and when operating in said homogeneous mode.

9. The method recited in claim 8 further comprising decreasing said throttle valve opening and retarding said ignition timing when said idle speed is greater than said first selected idle speed and when operating in said homogeneous mode.

10. The method recited in claim 5 wherein the stratified mode is generated by injecting fuel into the combustion chambers during a compression stroke of the engine.

11. The method recited in claim 5 wherein the homogeneous mode is generated by injecting fuel into the combustion chambers during an intake stroke of the engine.

* * * * *